US010701487B1

(12) United States Patent
Modafferi

(10) Patent No.: US 10,701,487 B1
(45) Date of Patent: Jun. 30, 2020

(54) CROSSOVER FOR MULTI-DRIVER LOUDSPEAKERS

(71) Applicant: Richard Modafferi, Vestal, NY (US)

(72) Inventor: Richard Modafferi, Vestal, NY (US)

( * ) Notice: Subject to any disclaimer, the term of this patent is extended or adjusted under 35 U.S.C. 154(b) by 0 days.

(21) Appl. No.: 16/452,486

(22) Filed: Jun. 25, 2019

(51) Int. Cl.
*H04R 3/04* (2006.01)
*H04R 3/12* (2006.01)
*H04R 3/14* (2006.01)
*H04R 1/22* (2006.01)

(52) U.S. Cl.
CPC ..... *H04R 3/14* (2013.01); *H04R 1/227* (2013.01); *H04R 3/04* (2013.01)

(58) Field of Classification Search
CPC ... H04R 3/00; H04R 3/04; H04R 3/12; H04R 3/14; H04R 5/04; H04R 1/20; H04R 1/227; H03G 3/00; H03F 21/00
See application file for complete search history.

(56) References Cited

U.S. PATENT DOCUMENTS 4,138,594 A * 2/1979 Klipsch ..... H04R 3/14 181/147
4,237,340 A * 12/1980 Klipsch ..... H04R 3/14 381/99
4,243,840 A * 1/1981 Kates ..... H04R 3/14 381/99
4,403,112 A 9/1983 Modafferi
4,589,135 A * 5/1986 Baker ..... H03H 11/1217 381/100
4,597,100 A * 6/1986 Grodinsky ..... H04R 3/14 381/99
4,771,466 A * 9/1988 Modafferi ..... H04R 3/14 381/100
4,897,879 A * 1/1990 Geluk ..... H04R 3/14 381/99
5,937,072 A * 8/1999 Combest ..... H04R 3/14 381/98
6,381,334 B1 * 4/2002 Alexander ..... H04R 3/14 381/99
7,085,389 B1 8/2006 Modafferi
2014/0219480 A1 * 8/2014 Collins ..... H04R 3/14 381/300
2015/0016634 A1 * 1/2015 Powell ..... H04R 3/00 381/120

OTHER PUBLICATIONS

John Atkinson, Joseph Audio Perspective Loudspeaker; Stereophile Jul. 2014, vol. 37, No. 7; Published by AvTechmedia America, Inc.; New York, NY USA.

* cited by examiner

*Primary Examiner* — Thang V Tran

(57) ABSTRACT

Crossover networks modified to render audible colorations or frequency/phase emphases observed in some crossover networks of the prior art. Circuit topologies of prior art crossover networks are modified such that an additional pole appears in the transfer functions of one or more low-frequency pass crossover filters. In addition, the characteristic input impedance of one branch of the modified crossover network is reduced, typically to a value of approximately one-half the design characteristic impedance of the unmodified crossover networks.

6 Claims, 11 Drawing Sheets

Low-pass: 2 kHz

High-pass 2 kHz
Two-way and Three-way

CROSSOVER FOR MULTI-DRIVER LOUDSPEAKERS

RELATED APPLICATIONS

This application is related to U.S. Pat. No. 4,403,112 for "Phase-Shift Low Frequency Loudspeaker System" issued Sep. 6 1983, hereinafter the '112 patent; and U.S. Pat. No. 7,085,389 BI for "Infinite Slope Loudspeaker Crossover Filter" issued Aug. 2, 2006, hereinafter the '389 patent, all issued to Richard Modafferi and included herein in their entirety by reference.

FIELD OF THE INVENTION

The present invention pertains to loudspeaker systems and, more particularly, to crossover networks displaying a combination of both steep and shallow slopes in filter amplitude responses and presenting substantially constant input impedances at their inputs. The present invention also provides improved crossover filter phase/delay responses relative to crossover filters of the prior art.

BACKGROUND OF THE INVENTION

High-Fidelity loudspeaker systems are generally realized by dividing the audible frequency spectrum into two or more frequency bands and then applying each of these bands to appropriate individual loudspeaker drivers. Frequency band division is typically accomplished by so-called crossover network filters. By using appropriately designed crossover network filters, each driver then can be optimized to best reproduce a particular predetermined range of frequencies for which it is designed. When combined in a loudspeaker system, drivers and crossover filters together comprise a speaker system. Such speaker systems are then capable of more accurately reproducing the entire audible frequency range.

Crossover filters belong to three general types: (1) low-pass filter (LPF) typically used for "woofers" (low frequency drivers); (2) band-pass filters (BPF) used with mid-range drivers middle frequencies (e.g., the approximate range of a human voice); and (3) high-pass filters (HPF) typically used with so called "tweeter" drivers (high frequencies typically to approximately 20 KHz).

A woofer and tweeter together with their respective LPF and HPF comprise a so-called "two-way" loudspeaker system well-known to those of skill in the art. In a two-way system, the woofer is typically adapted to provide an upper frequency response extending into to the lower portion of midrange frequencies and possibly a tweeter having a low frequency response extending down into the upper portion of the midrange frequencies. A block diagram of a two-way speaker system of the prior art is shown in FIG. 1*b*.

Adding a midrange driver with its respective BPF to a two-way system creates a so-called "three-way" loudspeaker system also well-known to those of skill in the art. The midrange driver with its associated BPF reproduces a predetermined portion of the midrange frequency spectrum, thereby relieving the woofer and tweeter from needing to do so. A block diagram representation of a three-way speaker system is shown in FIG. 2*b*.

However, as speaker systems were realized using the crossover networks disclosed in the inventors '389 patent, a slight emphasis of the sound were sometimes observed at frequencies at or near the crossover frequencies. These emphases were both seen in frequency response measurements and were heard in listening sessions.

The Joseph Audio "Pearl"™ loudspeaker has been widely demonstrated many times and has received high praise. At the Consumer Electronics Show (CES) in Las Vegas, January, 2014, the Pearl™ speaker received the "Best Sound in Show" award. There has been many other high honors granted including, for example, at the January 2017 CES as well as other honors given to them at the Rocky Mountain Audio Fest over a period of several years. An Internet search will immediately provide documentation of the accolades received for Joseph Audio Pears™ as well as other speaker models from Joseph Audio using crossover networks designed by the present inventor.

The present inventor had designed a novel, asymmetrical "infinite slope" crossover for the Pears™. Over the course of the life of the Pearl™ speakers, some reviewers (as well as the inventor) noted unusual slight but audible coloration in the area of the crossover frequency, typically at or near the 2 kHz ⅓ octave band. The present inventor pondered what could possibly be causing this phenomenon. He deduced that a localized phase error might possibly be responsible. His intuition caused him to initially discard that theory.

Several years passed and the inventor designed a new crossover for a new Joseph Audio product, the "Perspective Loudspeaker" introduced in May, 2011. Noted reviewer John Atkinson of Stereophile Magazine reviewed the "Perspective" in the July, 2014 issue of Stereophile. John's review included detailed precision measurements that he reported in his review:

> "The low-frequency, ⅓-octave band warble tones on my Editor's Choice (CD, Stereophile STPH016-2) were reproduced with full weight down to the 25 Hz band, but with the 32 Hz warble tone significantly reinforced by a room mode. The 20 Hz warble tone was inaudible at normal listening levels. With the half step-spaced toneburst track on the Editor's Choice, the lower frequency tones spoke relatively clearly, but there was some emphasis of the upper-frequency tones in the octave below 4.2 kHz. This presence-region emphasis could also be heard with the dual-mono pink noise from Editor's Choice though the Perspective's reproduction of this signal was otherwise seamless through quite a large vertical window, as long as I didn't stand up. The central image of the pink noise was appropriately narrow and well defined." [Emphasis added] [Stereophile Magazine, Volume 37, No. 7, pp 62-71]

This measurement by John Atkinson rekindled the inventor's curiosity regarding the cause of this anomaly. Having never forgotten his theory that some unusual phase error was occurring at the crossover frequency, the inventor undertook a series of experiments to prove or disprove that theory.

It would, therefore, be advantageous to provide improved crossover networks for multi-driver speaker systems that maintained a substantially uniform frequency and phase response at or near all crossover frequencies.

SUMMARY OF THE INVENTION

In accordance with the present invention there are provided improved circuit topologies that eliminate the slight amplitude and phase errors at or near the individual crossover frequencies in the crossover network. First, an additional "pole" is added in the transfer function(s) of the individual low-pass and band-pass filters of the improved crossover network. In addition, design input impedance of the crossover series R-L-C branch at the input to the crossover network has been reduced, typically to approximately one-half the design impedance of crossover filters.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides improved crossover networks for two-way, three-way and multi-way loudspeaker systems wherein coloration anomalies at or near one or more the crossover frequencies are greatly decreased or eliminated.

High fidelity loudspeaker systems are typically realized by dividing the audio frequency spectrum into two or more discrete frequency bands that are then applied to appropriate loudspeaker drivers. To divide the audio frequency spectrum, two or more individual crossover filters are used. By matching the frequency response characteristic of each loudspeaker driver with the output of each crossover filter, a complete loudspeaker system may be assembled.

Crossover filters belong to three general types: (1) low-pass filters for woofers (bass frequencies); (2) band-pass filters for midrange drivers (middle frequencies in the range of the human voice), and (3) high-pass filters for tweeter drivers (high frequencies up to 20 kHz). Woofer, midrange, and tweeter together form a so-called three-way loudspeaker system well known in the prior art. A so-called two-way loudspeaker system, also well known in the prior art, has no separate midrange driver and bandpass associated filter. Instead the woofer driver low pass frequency crossover extends upward into the human voice region as well as reproducing bass frequencies. The usual tweeter with its high-pass crossover filter reproduces high frequencies up to typically approximately 20 kHz.

Constant-resistance network circuit topologies have been used in crossover filters in inventor's '389 patent. Similar circuit topologies are used in the crossover networks of the present invention.

A series-connected constant-resistance network reactance branch is typically added at the input terminals of the entire crossover-loudspeaker system.

Figure 1A:
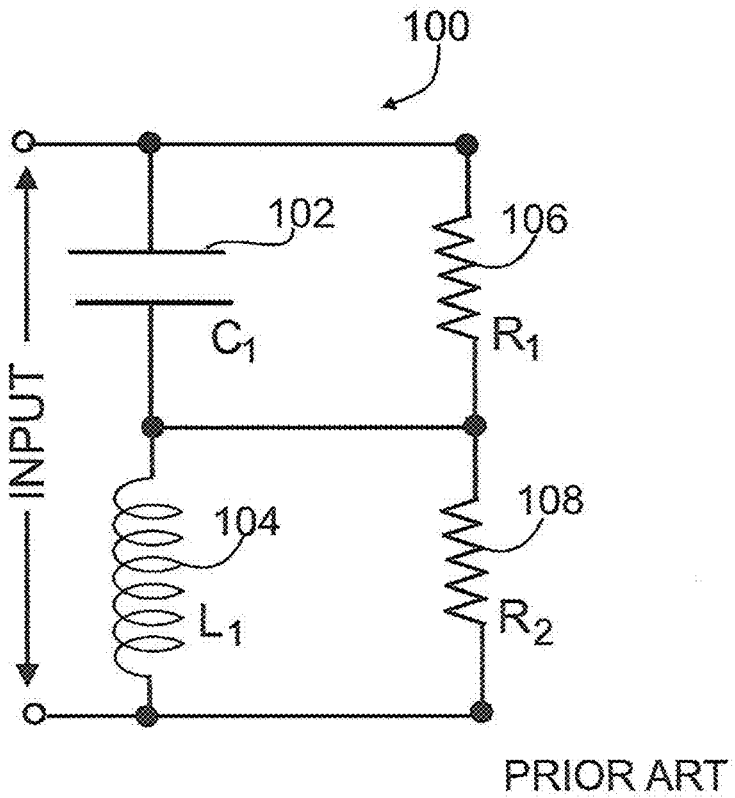
FIG. 1*a* is a schematic diagram of one type of a constant-resistance electrical network of the prior art.
Figure 1B:
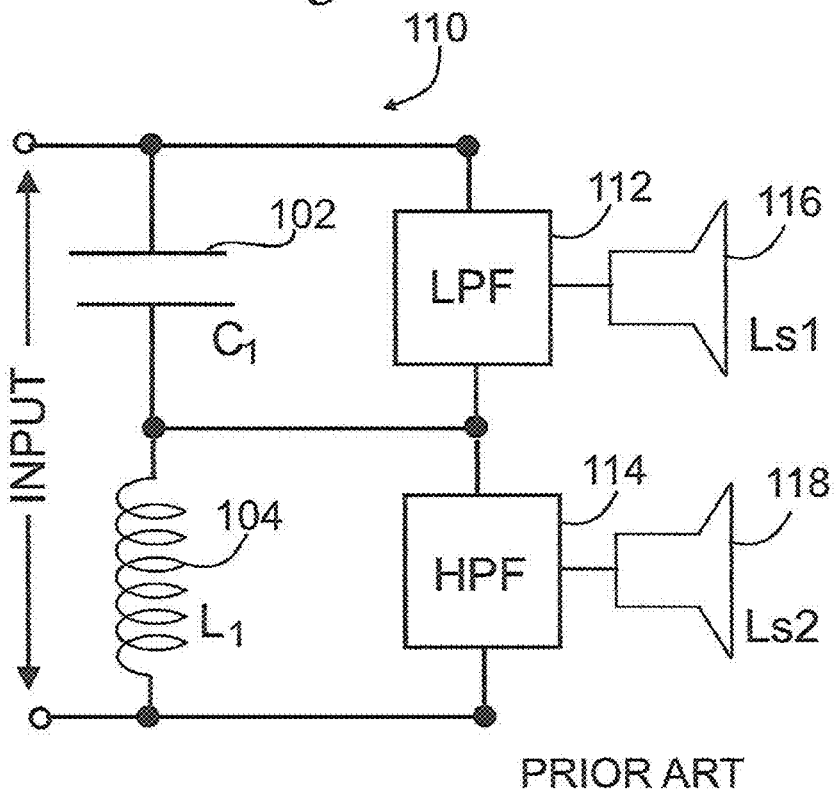
FIG. 1*b* is a block diagram of a two-way speaker system in accordance with the prior art.

Referring first to FIGS. 1*a* and 1*b*, there are shown a schematic diagram of one type of a constant-resistance electrical network of the prior art, generally at reference number 100 and a block diagram of a two-way loudspeaker system or the prior art, generally at reference number 110, respectively.

The constant-resistance branch in network 100 is defined by the following equations:

$$Z_0=R_1=R_2=(L/C)^{1/2}$$

$$Z_0=1/jwC=jwL$$

$$w=2\pi f$$

where:

$Z_0$ is the network input impedance in ohms, typically 8 ohms $R_1$ 106 and $R_2$ 108 are resistance in ohms, typically 8 ohms C 102 is capacitance in Farads (F)

L 104 is inductance in Henries (H)

F is the desired crossover frequency in Hertz (Hz)

Using an assumed network design input impedance ($Z_0$) value of 8 Ohms, typically an industry standard, and entering a selected crossover frequency associated with one of the Low Pass Filer (LPF) 112, Band-pass Filter (BPF) 126 (FIG. 2*a*) and the High-pass filter (HPF) 114, the required values for $C_1$ 102 and $L_1$ 104 may readily be obtained using a Shure Reactance Slide Rule issued by Shure Brothers, Inc of Chicago, Ill., originally provided in 1942. It will be recognized by those of skill in the art that other standard (e.g., 4 ohms, 16 ohms, etc.) as well as non-standard impedances may be chosen and the invention is not considered limited to the 8 ohm impedance chosen for purposes of disclosure. It will be further recognized by those of skill in the art that other calculators, computer programs, manual calculations, or cellular phone applications ("apps") may alternately be used to determine values of $L_1$ 104 and $C_1$ 102.

Once the network impedance $Z_0$ is selected and the desired crossover frequency is entered, the values of $C_1$ 102 (typically in microfarads) and $L_1$ 104 (typically in millihenries or microhenries) may be "read" from the Shure Reactance Slide Rule.

Figure 2A:
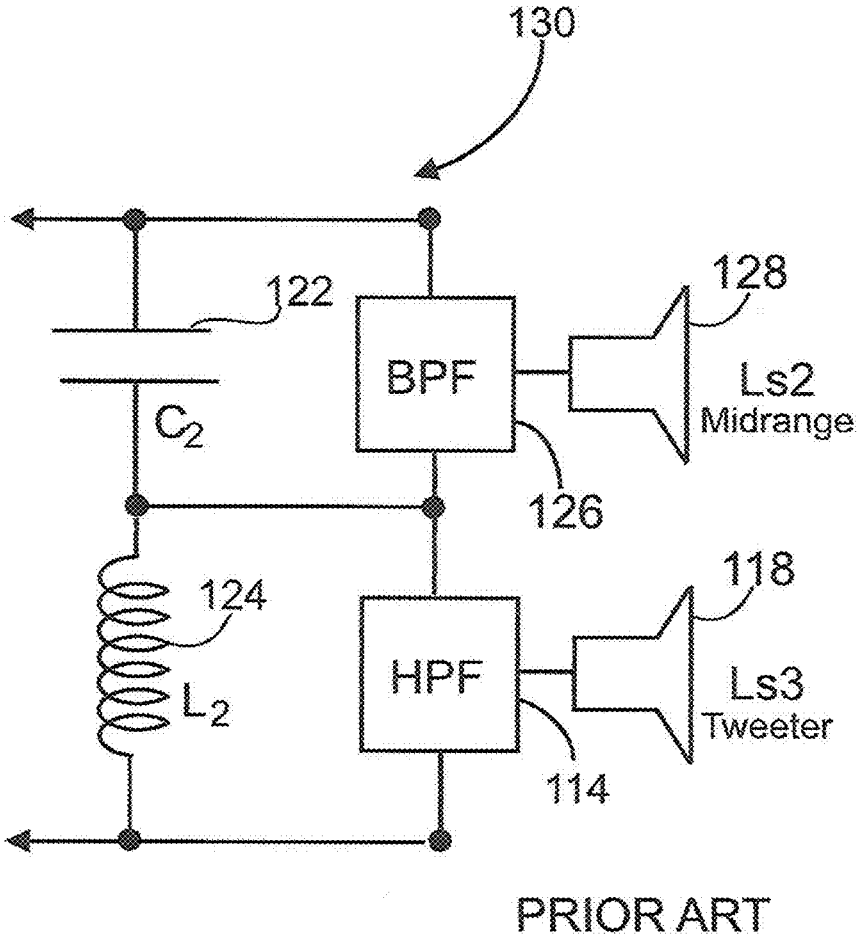
FIG. 2*a* is a block diagram of a module that may be added to the circuit of FIG. 1*b* to obtain the three-way crossover network of FIG. 2*b* in accordance with the present invention.
Figure 2B:
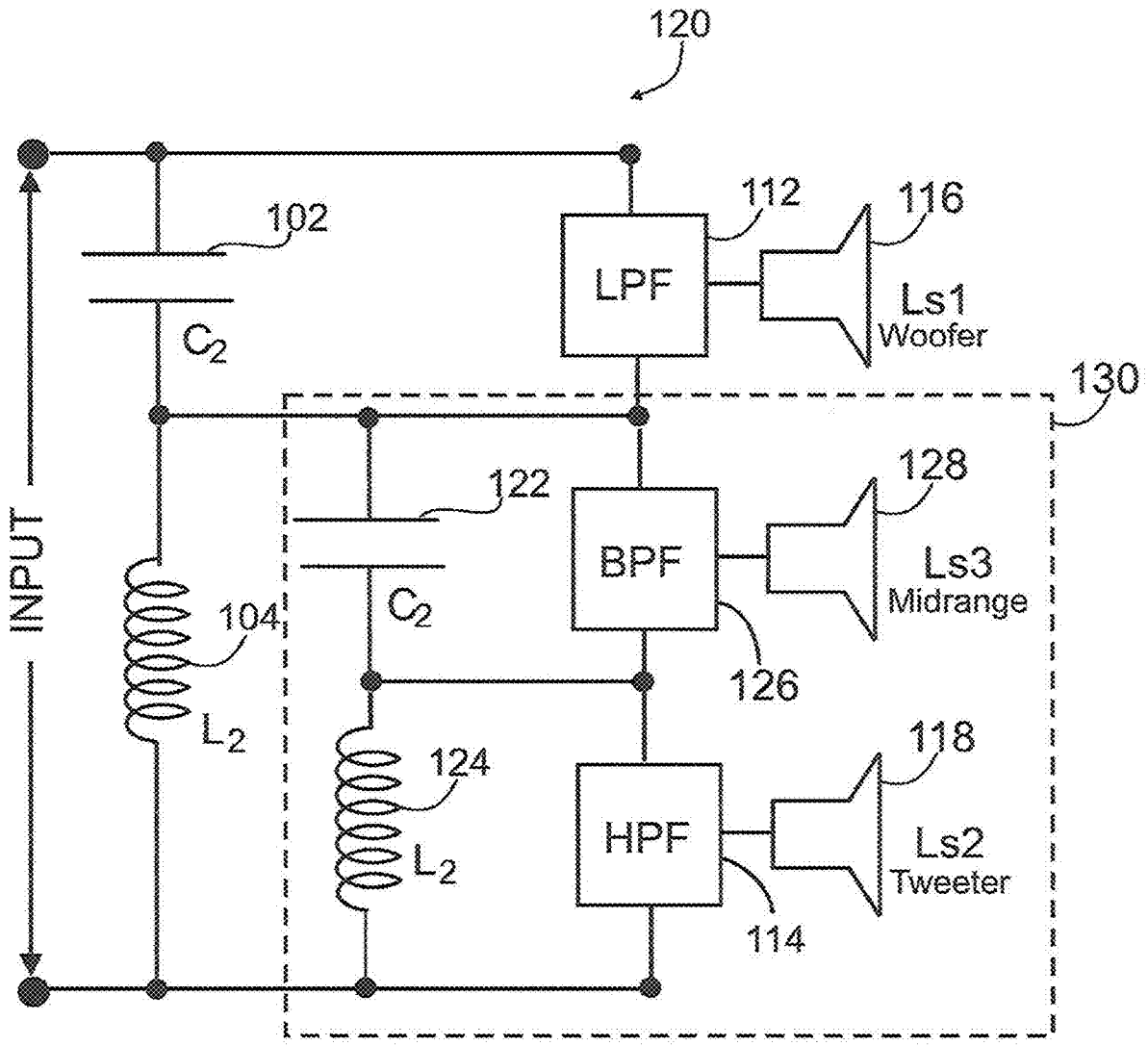
PRIOR ART Figure 2b
FIG. 2*b* is a block diagram of a three-way loudspeaker system in accordance with the present invention that includes the circuit module of FIG. 2*a;*

Calculations are independently performed for each filter network (e.g., LPF 112, BPF 126 and HPF 114 as shown in FIGS. 1*b* and 2*b*).

It will be further recognized that alternate design input impedances $Z_0$, for example 16 Ohms, 4 Ohms or 2 Ohms may likewise be chosen. For non-standard applications, other input impedances $Z_0$ may also be chosen.

Referring now also to FIG. 1*b*, there is shown a block diagram of a two-way loudspeaker system in accordance with the present invention, generally at reference number 110. In crossover network 110, resistor $R_1$ 106 is replaced by LPF 112 and driver $LS_1$ 116 and resistor $R_2$ 108 is replaced by HPF 114 and driver $LS_2$ 118.

The output of LPF 112, not specifically identified, is connected to a first loudspeaker $Ls_1$ 116, typically a low-frequency/midrange driver) and the output, not specifically identified, of HPF 114 is connected to a second loudspeaker $Ls_2$ 118, (typically a high-frequency driver). It will be recognized that suitable audio frequency (AF) amplification of the outputs of LPF 112 and HPF 114 is typically required. For purposes of simplicity, such AF amplification has been omitted from FIGS. 1*b* and 2*b*.

"Infinite slope" designs may be used for the upper (higher-frequency) band edge of the low-pass and band-pass filters (e.g., LPF 112 and BPF 126 (FIG. 2*b*)). Optionally infinite slope designs may be used in high-pass filters (e.g., HPF 114) in crossover networks. Infinite slope design may also be used optionally in lower band-edge of band-pass filters (e.g., LPF 112).

Referring now also to FIG. 2*a*, there is shown a block diagram of a high-frequency/mid-band frequency module used to modify the circuit of FIG. 1*b* from a two-way crossover network to a three-way crossover network, generally at reference number 130. Effectively, module 130 is substituted for HPF 114 and LS2 118 as shown in FIG. 1*b*.

Referring now also to FIG. 2*b*, there is shown a block diagram for a three-way loudspeaker system in accordance with the present invention, generally at reference number 120. Module 130 is shown enclosed within a broken line box.

As discussed hereinabove, loudspeaker systems constructed using prior art crossover networks such as those shown in inventor's '112 and '389 patents included herein by reference have been shown to exhibit the unusual audible sonic colorations in the area of one or more crossover frequencies, typically at or near the 2 kHz ⅓ octave band.

The present inventor pondered what could possibly be causing this phenomenon. He originally deduced that a strange localized phase shift might possibly be responsible.

Ultimately, the inventor designed some tests to look for phase error(s) at crossover frequencies in loudspeaker systems at the frequencies where these sonic colorations were heard.

Figure 3A:
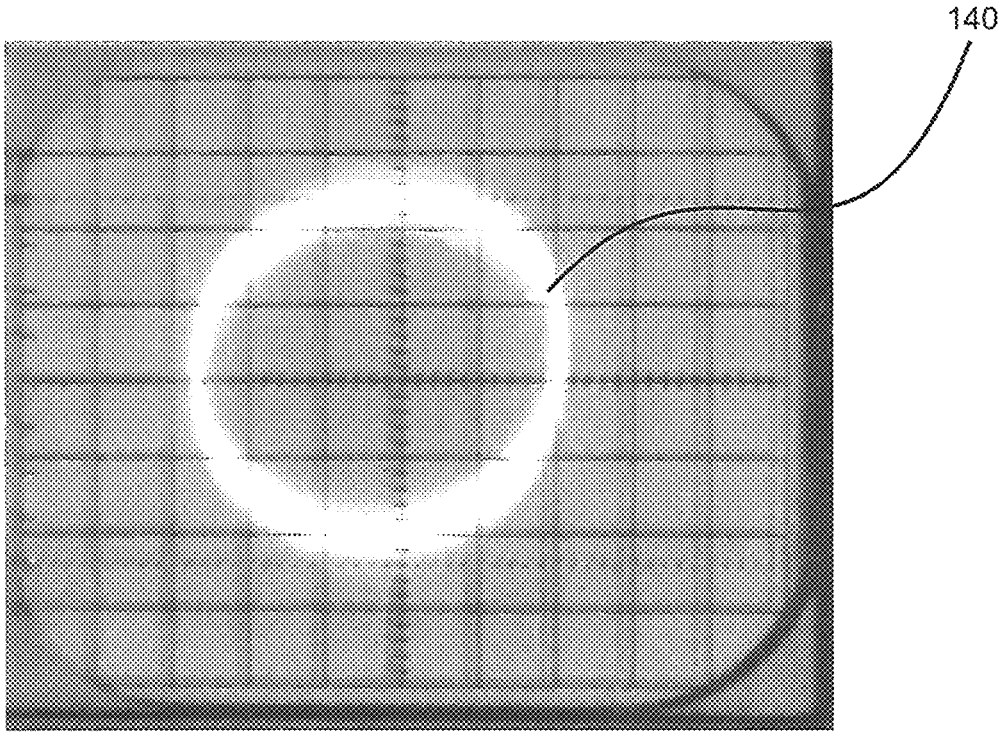
PRIOR ART Figure 3a
FIG. 3*a* is an oscilloscope traces showing a phase shift of the unmodified crossover network of the prior art.
Figure 3B:
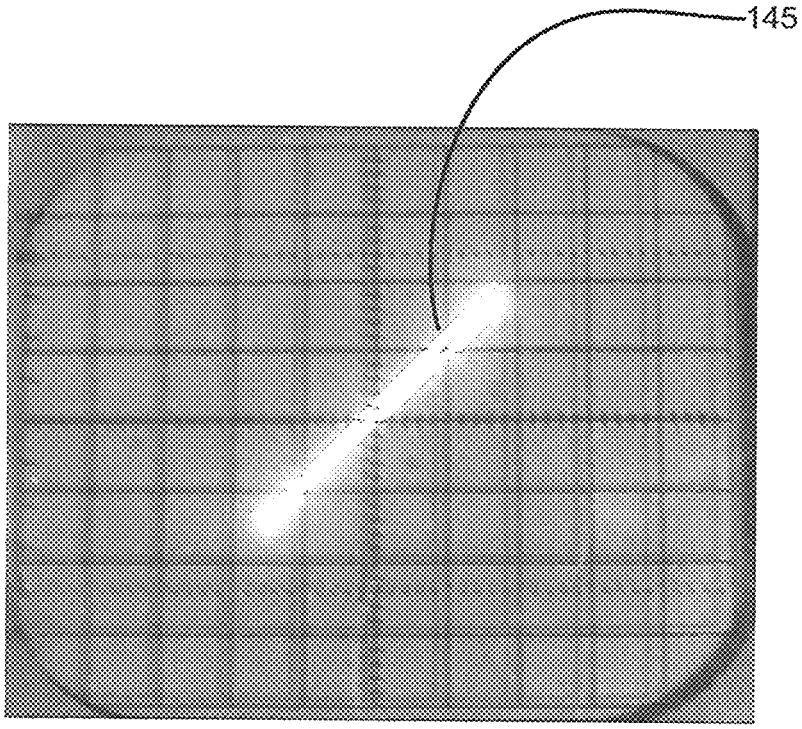
FIG. 3*b* is an oscilloscope traces showing a phase shift of the modified crossover network in accordance with the present invention.

Referring now also to FIGS. 3*a* and 3*b*, there are shown two oscilloscope traces, generally at reference numbers 140 and 145, respectively. Both traces 140, 145 were produced by the apparatus 500 shown in FIG. 9.

Figure 9:
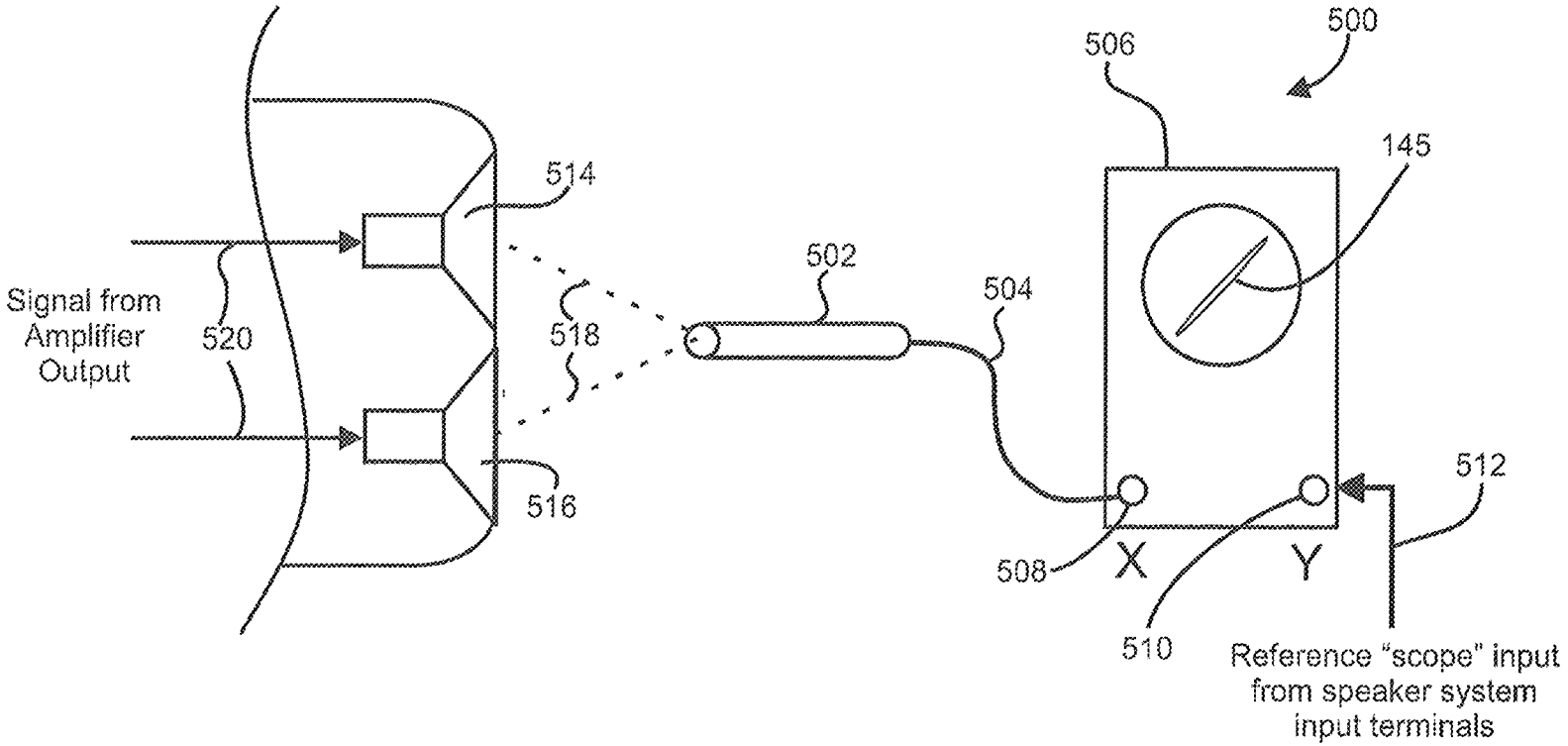
FIG. 9 is a simplified block diagram of a measurement apparatus for obtaining the oscilloscope traces for FIGS. 3*a* and 3*b*.

Referring now also to FIG. 9, microphone 502 is positioned on-axis with, and a few inches in front of two loudspeaker drivers 514, 516 as shown by lines 518. Loudspeaker drivers 514, 516 are electrically connected to an amplifier, not shown, by a suitable electrical connection, also not shown, and an electrical signal of 2.0 kHz is applied the inputs 520 of loudspeaker drivers 514, 516.

In a two-way speaker system, loudspeaker driver 516 would probably be a low-frequency "woofer" with frequency response extending into mid-range frequencies. In a three-way loudspeaker system, speaker driver 516 would probably be a mid-range driver. Loudspeaker driver 514 would probably be a high-frequency "tweeter" in both two-way and three-way loudspeaker systems.

Oscilloscope 506 typically has both an X-axis 508 and a Y-axis 510 input to which two different signals may be applied, respectively. When two signals are applied, the phase difference of the two applied signals results in a so-called "Lissajous" figure exemplified by traces 140 and 145 of FIGS. 3*a* and 3*b* respectively. For the example shown in FIGS. 3*a* and 3*b*, a 2 kHz sinusoidal signal is applied to the speaker terminals 520. 2 kHz frequency is chosen as it is the frequency of one of filters in the crossover network, not shown. This technique for evaluating phase differences is believed to be well known to those of skill in the audio arts.

In the example shown in FIG. 9, the X input 508 is supplied by a signal from microphone 502 via signal cable 504. The Y-axis input 510 is supplied by a signal collected at the input terminals of the loudspeaker system being evaluated.

In loudspeaker systems of the prior art, the Lissajous pattern 140 of FIG. 3*a* is obtained by the arrangement of FIG. 9. The substantially circular pattern 140 indicates that crossover filter, not shown, is in "quadrature" meaning that there is an approximately a 90° phase shift between the input signal at the X-axis input 508 and the Y-axis input 510. In this case the acoustic sum has a phase relationship with respect to the signal input to the speaker driver 514 or 516 is defined by the equation:

$$\varnothing = n\pi/2 \text{ where } n=1, 3, 5 \ldots$$

Experimentation showed the inventor that a corrective modification could be made to the crossover filter in his prior art crossover networks. These corrections yielded the crossover filters of the present invention that greatly reduce or eliminate all high-frequency "emphasis" previously present in some of his crossovers of the prior art. Measurements confirmed that in the "corrected" circuits in the revised crossover networks that the signals measured to be substantially in phase.

In FIG. 3*b*, oscilloscopes trace 145 shows substantially a straight line rotated at approximately a 45° angle—the indication of the two signals presented at the X-axis 508 and the Y-axis 509 inputs are in phase. Trace 145 is defined by the equation:

$$\varnothing = n\pi \text{ where } n=0, 2, 4, 6 \ldots$$

A further examination of data from computer models of both the prior art and improved crossovers of the present invention provides data that corroborates the results depicted in traces 140 and 145 of FIGS. 3*a* and 3*b*, respectively.

Figure 6:
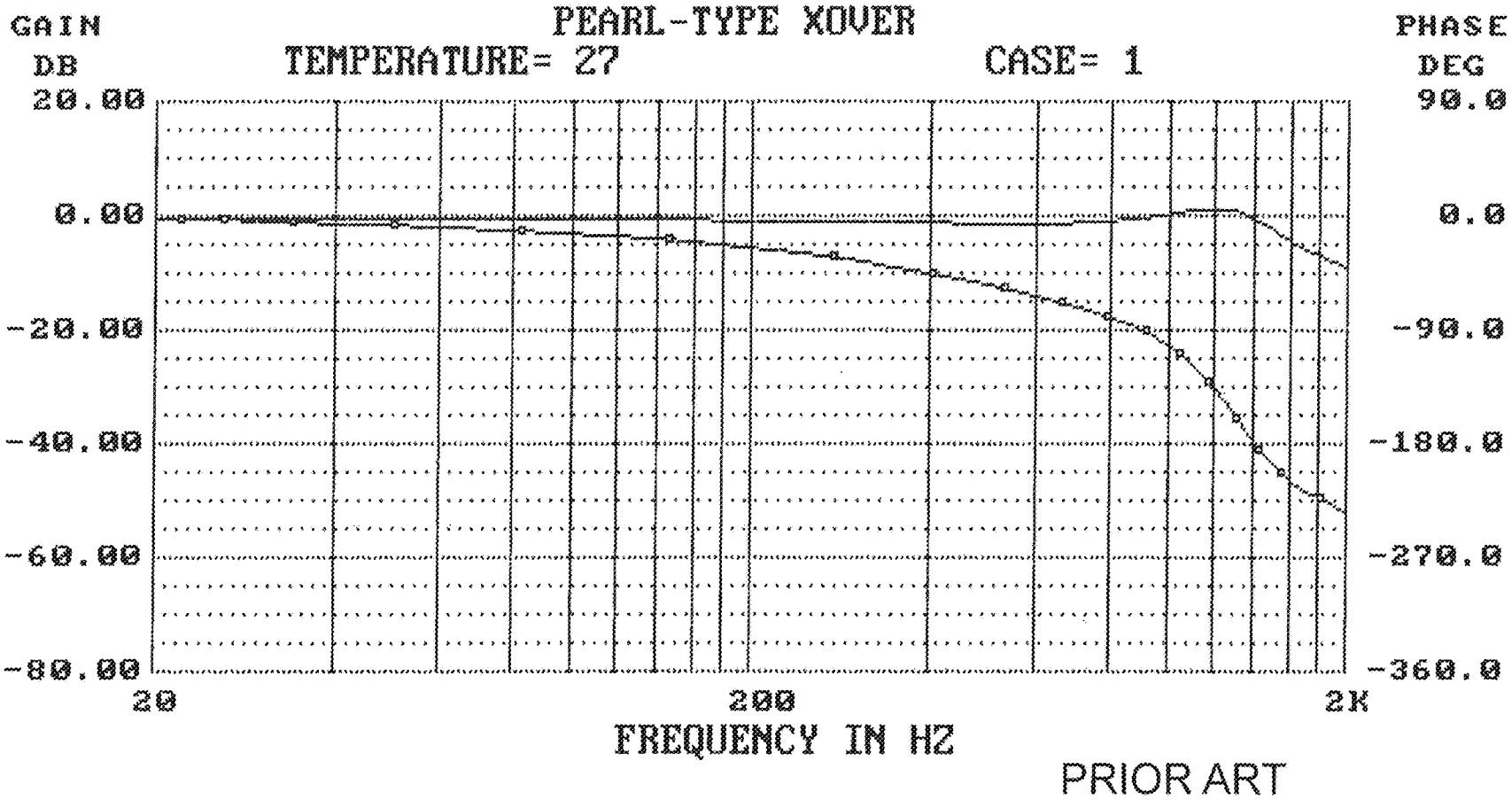
PRIOR ART Figure 6
FIG. 6 is a frequency/phase response graph of a Micro-Cap simulation of a low-pass crossover filter with a 2 kHz cut-off frequency of the Prior art.
Figure 7:
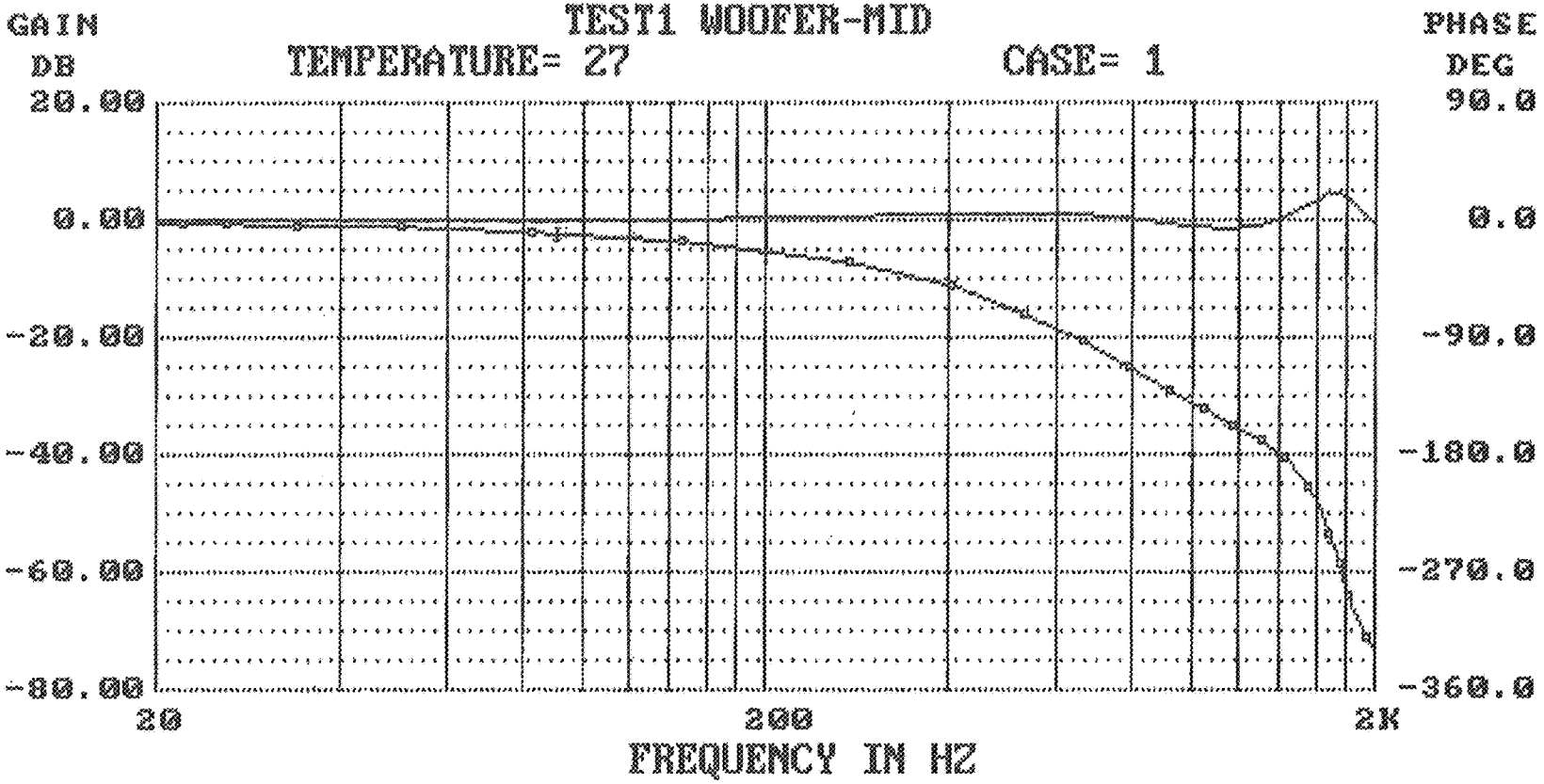
FIG. 7 is a frequency/phase response graph of a Micro-Cap simulation of another low-pass crossover filter with a 2 kHz cut-off frequency in accordance with the present invention.
Figure 8:
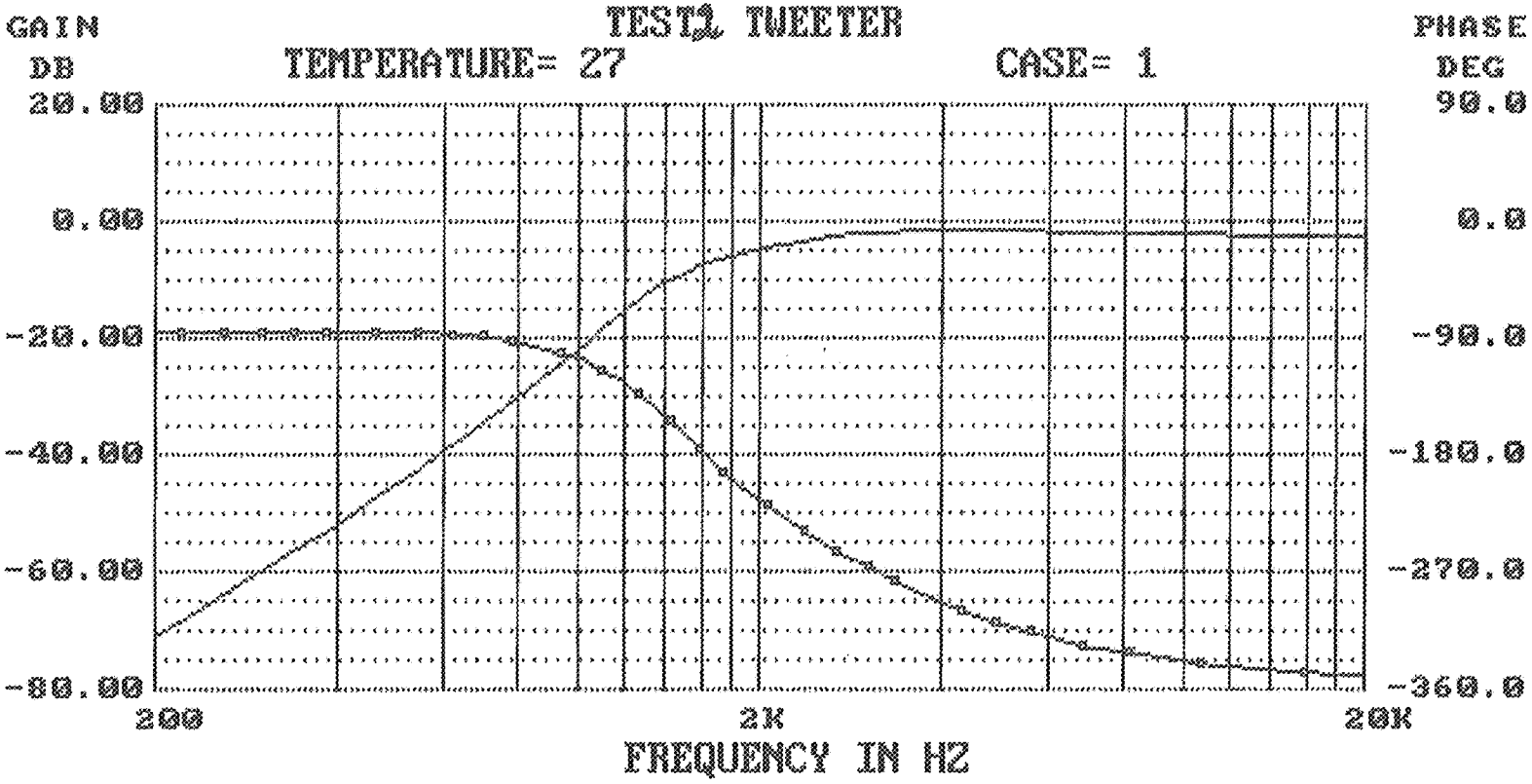
FIG. 8 is a frequency/phase response graph of a Micro-Cap simulation of high-pass filter network with a 2 kHz cut-off as used in two-way and three-way speaker systems of both the Prior art and the present invention.

Referring now also to FIGS. 6 and 7, there are shown frequency and phase response curves for computer simulations of a low-pass network filter in crossover networks described in the inventors '389 patent and for a crossover network of the present invention, respectively. Simulations were performed using Micro-Cap software provided by Spectrum Software of Sunnyvale, Calif. In both FIGS. 6 and 7, amplitudes at the 2 kHz crossover frequency (upper traces) are substantially the same; however the phase responses (lower traces) are different Referring now also to FIG. 8, there is shown a frequency/phase response plot for a high-frequency driver (tweeter) that is substantially the same in loudspeaker systems using the crossover networks as shown in the '389 patent and loudspeaker systems using a crossover network in accordance with the present invention. The frequency response (upper trace) and the phase response are identical. At the 2 kHz frequency, the phase (lower trace) is approximately 1800.

In FIG. 6, (Prior Art), it may be seen that phase at the 2 kHz frequency is approximately 270°. Consequently, the phase difference may be calculated as:

Midrange (FIG. 6) at 270°−Tweeter (FIG. 8) at 180°=900

This confirms that low-pass network filter in the crossover as described in the '389 patent (prior art) is operating in quadrature at the 2 kHz crossover frequency.

In the crossover network of the present invention, the phase at the 2 kHz crossover frequency may be seen to be approximately 3600. Consequently, the phase difference may be calculated as:

Midrange at 360°−Tweeter at 1800=1800

At 1800 phase shift, the tweeter is completely out-of-phase with the mid-range driver. This out-of-phase condition is easily corrected by reversing the leads to the tweeter driver as shown in the schematic diagrams of FIGS. 4 and 5.

Listening tests to loudspeaker systems constructed with the crossover network modifications showed an audible improvement in the overall sound delivered by these loudspeaker systems. Most notably, the audible coloration of the sound near one or more crossover frequencies was/were absent.

Figure 4:
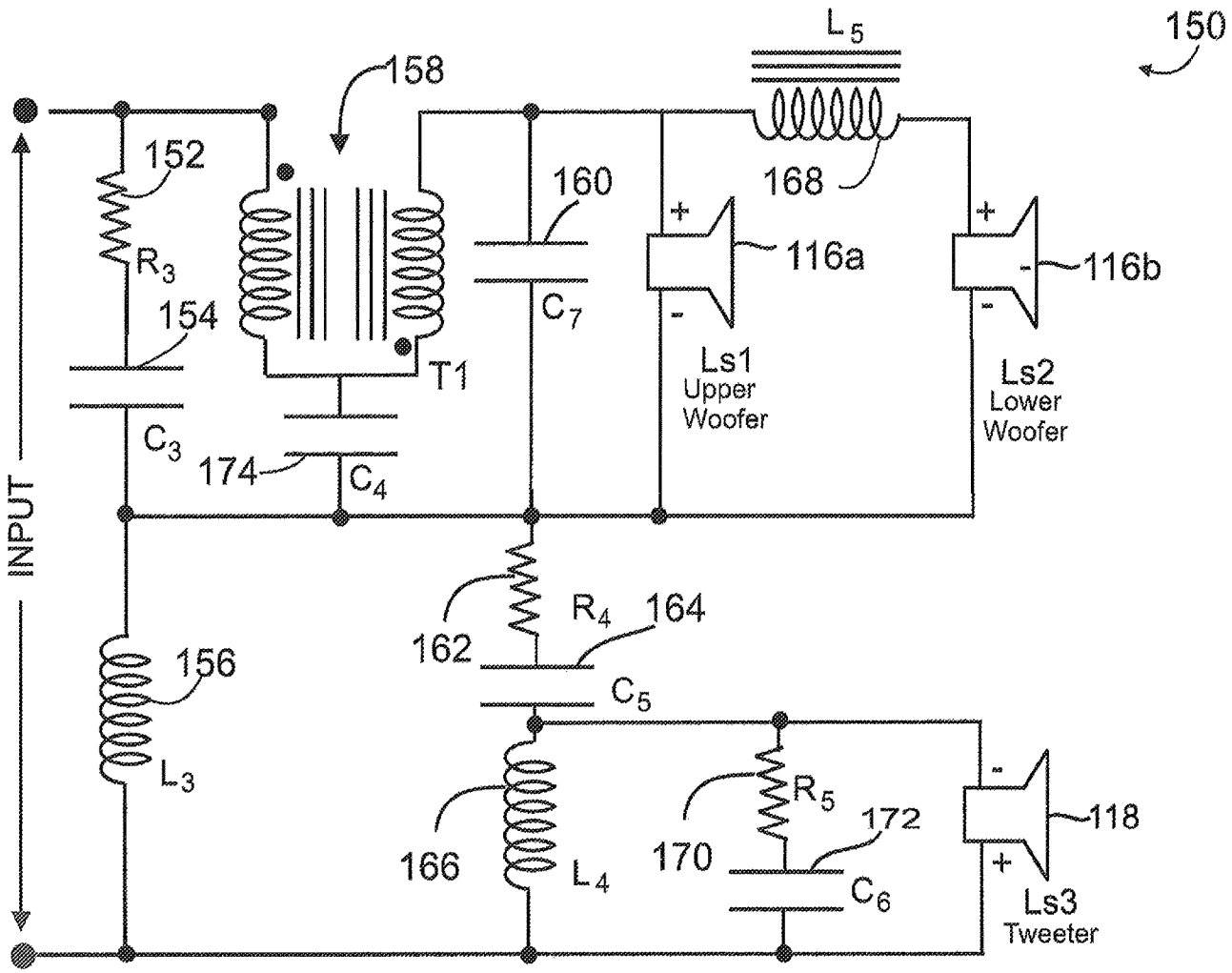
FIG. 4 is a schematic diagram of one embodiment of a two-way crossover network in accordance with the present invention.
Figure 5:
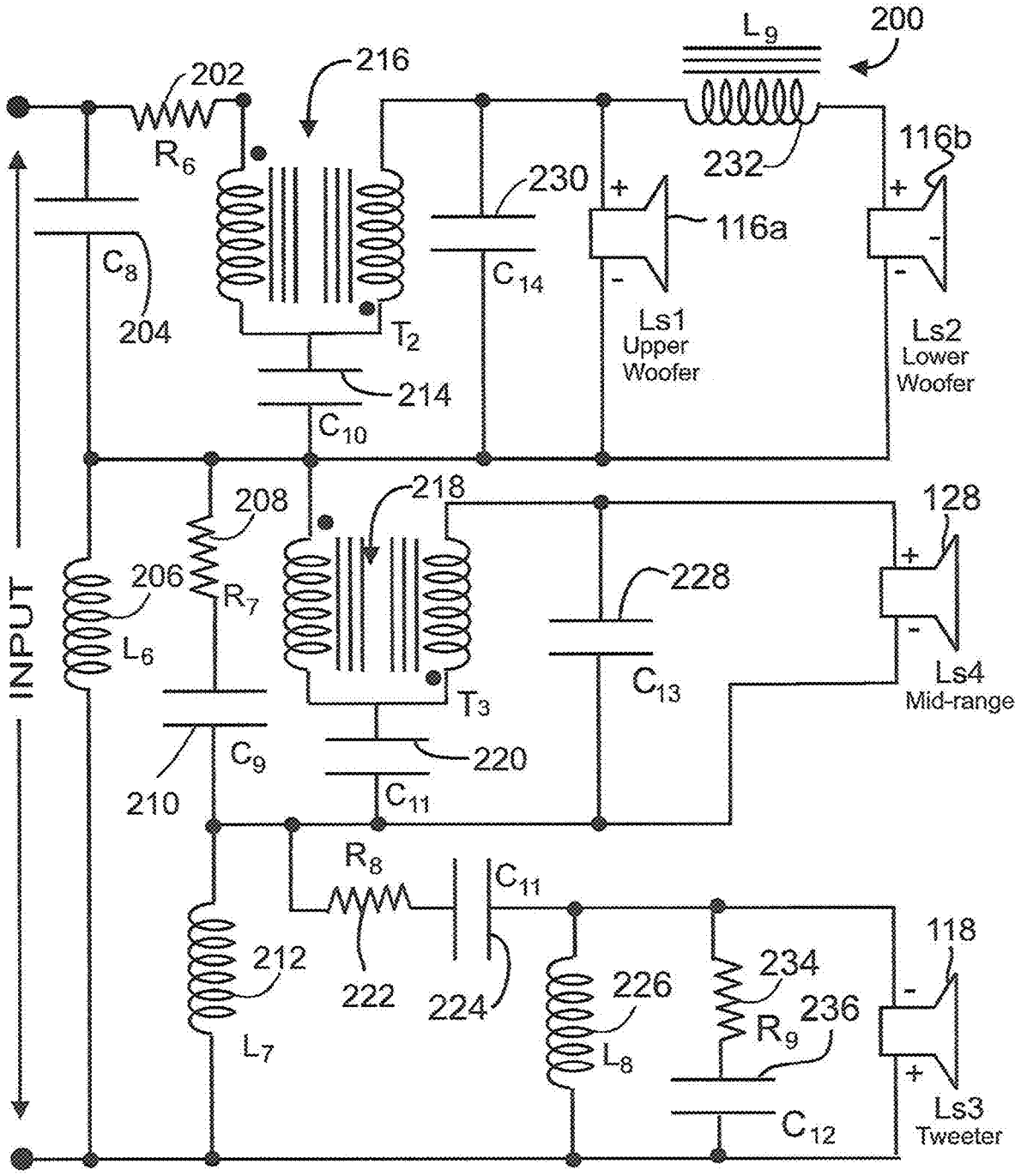
FIG. 5 is a schematic diagram of one embodiment of a three-way crossover network in accordance with the present invention.

Referring now also to FIG. 4, there is shown a two-way crossover network schematic in accordance with the present invention, generally at reference number 150.

Crossover network 150 supports a loudspeaker system having a pair of low-frequency drivers 116*a* 116*b* (woofers) and a high-frequency driver (tweeter) 118.

An inductor $L_5$ 168 in placed in series with low-frequency driver LS2 116*b*. This use of inductor $L_5$ 168 is discussed at length in the present inventors '114 patent included herein by reference. In summary, the use of inductor $L_5$ 168 and LS2 116*b* radiates only low-frequencies and thereby eliminates wave interference with sound emitted by LS1 116*a* that us allowed to radiate mid-range frequencies as well as low frequency sounds.

As is well known to those of skill in the art, crossover networks all have a so-called transfer function. It is beyond the scope of this disclosure to further discuss transfer functions. Suffice it to say that transfer functions have "poles" and "zeros" that are a function of the circuit topology of the particular crossover network.

The addition of capacitor $C_7$ 160 adds an additional "pole" to the transfer function for circuit 150 of FIG. 4. This addition to the low-cross crossover 150 explains at least a portion of the enhanced circuit performance.

The low-pass filter function for both woofers LS1 116*a* and LS2 116*b* are performed by the mutually-coupled coils $T_1$ 158 along with capacitors $C_4$ 174 and newly-added $C_7$ 160.

Three components, $R_4$ 162, $C_5$ 164 and $L_4$ 166 form a high-pass filter for tweeter $LS_3$ 118.

A so-called "Zobel network" is formed from resistor $R_5$ 170 and capacitor $C_6$ 172. As is well known to those of skill in the art, a Zobel network may be added to loudspeaker crossovers networks having high-pass filters terminated in a tweeter. Such circuit topologies commonly display a crossover system input impedance magnitude rise towards infinity at very high frequencies. This rise of input impedance at highest audible audio frequencies and beyond may cause peaks in speaker system high treble response and possibly instability and/or poor transient response in amplifiers due to interaction between the loudspeaker system and amplifier feedback circuits. In addition, Zobel networks typically result in a flat crossover system input impedance at highest audible frequencies (e.g., approximately 20 kHz.) and beyond. Also, peaks in treble response in the loudspeaker system are minimized.

Finally, the overall input impedance of crossover network 150 is controlled by the series R-L-C network branch consisting of resistor $R_3$ 152, capacitor $C_3$ 154 and inductor $L_3$ 156. In loudspeaker crossover networks of the prior art, the input impedance was typically matched to the impedance of the drivers (e.g., Ls1, Ls2, Ls3, etc.)—typically 8 ohms. However, the inventor determined that reducing the impedance from its prior art value (i.e., 8 ohms) to a substantially lower value also helped correct the problem of a slight emphasis of frequencies at or near a crossover frequency. In the cross-over circuit chosen for purposes of disclosure, the overall input impedance is reduced from 8 ohms to approximately 4 ohms by the choice of component values for resistor $R_3$ 152, capacitor $C_3$ 154 and inductor $L_3$ 156.

This change to the characteristic impedance of the series R-L-C network branch combined with the added pole in the transfer functions of one or more low-pass filters in the crossover network results in an improvement sound (I.e., the elimination of the observed coloration at or near crossover frequencies) in loudspeakers using the improved crossover networks in accordance with the present invention compared to loudspeakers using crossover networks in accordance with the inventor's '389 patent.

The inventor has not yet performed experiments to find an optimum reduced overall input impedance value but found that a reduction of 50% worked satisfactorily.

Component values for the two-way loudspeaker crossover network 150 are as follows:

Input R-L-C circuit (resistor $R_3$ 152, capacitor $C_3$ 154 and inductor $L_3$ 156):

Resistor $R_3$ 152=0.560
Capacitor $C_3$ 154=20 μf
Inductor $L_3$ 156=0.4 mH
Low-pass filter with 2 kHz cutoff components:
Mutually-coupled inductors $T_1$=1 mH (both inductors)
K (Coefficient of coupling)=0.15
Phase arrangement—Opposing
$C_4$ 174=$C_7$ 160=15 μf
Phase shift bass loading coil:
Inductor L3 168=17 mH
Tweeter 118 high-pass filter (2 kHz.)
Resistor $R_4$ 162=2Ω
Capacitor $C_5$ 164=6.8 μf
Inductor $L_4$ 166=0.5 mH
Zobel network:
Resistor $R_5$ 170=10Ω
Capacitor $C_6$=2 μf
Top and bottom woofers (Ls1.Ls2):
Morel Catalog No. TiCW 638Nd
Tweeter 118:
Morel CAT-308 1½ inch soft Referring now also to FIG. 5, there is shown a three-way loudspeaker system in accordance with the present invention, generally at reference no. 200. The crossover network of loudspeaker system 200 uses two woofers (upper and lower woofers Ls1 116*a* and Ls2 116*b*), a mid-range driver Ls4 238, and a tweeter driver Ls3 118.

Woofers Ls1 116*a* and Ls2 116*b* are connected to low-pass filter components T2 216 (consisting of a pair of mutually-coupled coils) and capacitors $C_{10}$ 214 and $C_{14}$ 230. In the example chosen for purposes of disclosure, the low-pass crossover frequency is set to 200 Hz. The two woofers Ls1 116*a* and Ls2 116*b* also function together to radiate bass frequencies using the method taught in inventor's U.S. Pat. No. 4,433,112 for Phase-Shift Low Frequency Loudspeaker System. The circuitry disclosed therein allows enhancement of bass frequency performance.

Midrange driver Ls4 128 functions in a frequency range of approximately 200 Hz to 2 kHz as set by high-pass action of C-L series-connected components $C_8$ 204, $L_6$ 206. A Low pass filter consists of mutually-coupled coils forming $T_3$ 218 and capacitors $C_{11}$ 220 and $C_{13}$ 228. This C-L arrangement simultaneously performs two functions. First, it passes a high-pass filtered signal to the midrange-tweeter portion of the circuit, not specifically identified. Second, the C-L circuit passes a low-pass filtered signal to top and bottom woofers Ls1 116*a*, and Ls2 116*b*, respectively.

The Low-pass filter to for mid-range driver Ls4 128 comprises mutually coupled coils forming $T_3$ 218 and capacitors $C_{11}$ 220 and $C_{13}$ 228.

The high-pass filter for tweeter driver Ls3 118 consists of a series R-L-C circuit branch formed by resistor $R_8$ 222, capacitor $C_{11}$ 224 and inductor $L_8$ 226 in combination with the inductor $L_7$ 212 forming part of the constant resistance network branch consisting of resistor $R_7$ 208, capacitor $C_9$ 210 and inductor $L_7$ 212.

Tweeter high-pass filter is to approximately 2 kHz.

Typical values for the components of loudspeaker 200 are chosen as shown.

Resistor $R_6$ 220–0.5 Ω
Capacitor $C_8$ 204–160 μF
Inductor $L_6$ 206–8.3 mH
Resistor $R_7$ 208–0.56 Ω
Mutually-coupled coils (T2 216), each coil 15 mH
Coefficient of coupling 0.2—phase opposing
Capacitor $C_{10}$ 214—80 μF
Capacitor $C_{14}$ 230—160 μF
Inductor $L_9$ 232—20 Mh
Capacitor $C_9$ 210—20 μF
Inductor $L_7$ 212—0.4 mH
Mutually-coupled coils ($T_3$ 218), each coil 1 mH
Coefficient of coupling 0.15—phase opposing
Capacitor $C_{11}$ 220—15 μF
Capacitor $C_{13}$ 228—20 μF
Resistor $R_8$ 222—2.0 Ω
Capacitor $C_{11}$ 224—6.8 μF
Inductor $L_9$ 226—0.5 mH
Resistor $R_9$ 234—10 Ω
Capacitor $C_{12}$ 236—2 μF
Top and bottom woofers Ls1 116*a*, Ls2 116*b*—SEAS L21RNX/P
Tweeter Ls3 118—SEAS T25CF 002-06
Midrange Ls4 238—SEAS W17F002

Two-way and three-way crossover network topologies have been described herein. The novel concepts of the present invention may readily be extended to crossover networks for four-way or, generally speaking, multi-way loudspeaker systems. Consequently, the novel concept is not considered limited to the two-way and three-way systems chosen for purpose's of disclosure.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A crossover network for a multi-driver loudspeaker system, comprising:

a) a low-pass crossover network filter circuit, having an input operatively connected to an input signal and having a characteristic input impedance and an output configured to connect to a low frequency driver;

b) a high-pass crossover network fitter circuit having an input operatively connected to said input signal, and having a characteristic input impedance, and an output configured to conned to a high frequency driver;

c) a modification circuit connected to said low-pass crossover network filter circuit that results in a modified crossover network low-pass filter circuit, said modified crossover network filter circuit having a transfer function with an additional pole relative to a transfer function associated with an unmodified crossover network low-pass filter circuit; and d) circuit for reducing crossover network input impedance connected to said low-pass crossover network filter circuit and to said high-pass crossover network filter circuit whereby said crossover network input impedance comprising said low-pass crossover network filter circuit input impedance and said high-pass crossover network filter circuit input impedance is reduced to approximately one-half the value of a crossover network input impedance of a crossover network without said circuit for reducing said crossover network input impedance.

2. The crossover network for a multi-driver loudspeaker system as recited in claim 1, wherein said low-pass crossover network filter circuit is an infinite slope crossover network low-pass filter circuit comprising an upper frequency slope of at least 120 dB/octave.

3. The crossover network for a multi-driver loudspeaker system as recited in claim 1, further comprising:

e. a band-pass crossover network filter circuit having an input operatively connected to said input signal and having a characteristic input impedance and an output configured for connection to a mid-frequency driver.

4. The crossover network for a multi-driver loudspeaker system as recited in claim 3, wherein at least one of said low-pass crossover network filter circuit and said band-pass crossover network filter it is an infinite slope crossover network filter comprising an upper frequency slope of at least 120 dB/octave.

5. A crossover network for a multi-driver loudspeaker system as recited in claim 4, wherein said at least one of said band-pass crossover network filter circuit and said high-frequency crossover network filter circuit comprises a relatively shallow lower frequency slope.

6. A crossover network for a multi-driver loudspeaker system as recited in claim 1, wherein said circuit for reducing said crossover network input impedance comprises an R-L-C network branch.

* * * * *